US006877552B1

(12) United States Patent
King

(10) Patent No.: US 6,877,552 B1
(45) Date of Patent: Apr. 12, 2005

(54) STATIC MIXER-HEAT EXCHANGER

(75) Inventor: Leonard Tony King, Wilmington, CA (US)

(73) Assignee: Komax Systems, Inc, Wilmington, CA (US)

( * ) Notice: Subject to any disclaimer, the term of this patent is extended or adjusted under 35 U.S.C. 154(b) by 0 days.

(21) Appl. No.: 10/686,386

(22) Filed: Oct. 14, 2003

(51) Int. Cl.[7] ..... F28D 7/10
(52) U.S. Cl. ..... 165/163; 165/159
(58) Field of Search ..... 165/156, 159, 165/162, 163, 172, DIG. 402

(56) References Cited

U.S. PATENT DOCUMENTS 921,811 A * 5/1909 Deckebach ..... 165/156
2,888,251 A * 5/1959 Dalin ..... 165/163
3,130,779 A * 4/1964 Huet ..... 165/163
3,130,780 A * 4/1964 Winship ..... 165/163
3,335,790 A * 8/1967 Aranyi et al. ..... 165/163
3,341,122 A * 9/1967 Whittell, Jr. ..... 165/163
4,462,463 A * 7/1984 Gorham, Jr. ..... 165/163
4,790,371 A * 12/1988 Zundel ..... 165/163
6,095,240 A * 8/2000 Hassanein et al. ..... 165/163

* cited by examiner

*Primary Examiner*—Teresa J. Walberg
(74) *Attorney, Agent, or Firm*—Dergosits & Noah LLP

(57) ABSTRACT

A device for effecting heat transfer from a first fluid medium to a second fluid medium and for enhancing mixing and uniform distribution of the second fluid medium within the confines of a conduit. The device includes providing a core pipe for receiving the first fluid medium and a series of helically wound tubes in fluid communication with the core pipe along the longitudinal axis of the conduit. The second fluid passes within the conduit and is mixed by virtue of the static mixing effect of the helically wound tubes and engages in heat transfer as a result of the intimate contact between the second fluid, the core pipe and the helically wound tubes.

7 Claims, 7 Drawing Sheets

STATIC MIXER-HEAT EXCHANGER

TECHNICAL FIELD OF THE INVENTION

The present invention is directed to a device for effecting heat transfer from a first fluid medium to a second fluid medium and for enhancing mixing and uniform distribution of the second fluid within the confines of a conduit.

BACKGROUND OF THE INVENTION

It is notoriously well known in the processing of fluid streams to employ static mixers and heat exchangers as enhancements in promoting product uniformity and adjusting product temperature. Mixers can contain active elements such as paddles and rotors although it is quite common to provide static elements whereby the turbulent flow of the fluids in and around these elements enhance fluid mixing without the need for moving parts which inherently add to the cost of the mixing operation both in terms of power requirements and labor intensive maintenance procedures. Many static mixers rely on a mixing element configuration that presents a set of interstices to the product flow. Elements of this type divide a fluid stream along the mixing path and recombine locally created sub streams into a more homogeneous mixture.

It is further common to contain within a conduit a series of tubes or pipes to effect heat transfer between a product stream and a fluid medium contained within tubes in contact with the flow of fluid product.

It has long been known that reduction of the internal film coefficient of the moving fluid product as it contacts the tubes or pipes of a conventional tube and shell heat exchanger is advantageous for reduction of the internal film coefficient enhances heat transfer. In this regard, reference is made to FIG. 1 showing a conventional tube and shell heat exchanger 10. In this configuration, the product enters orifice 13 at the upstream end of the heat exchanger and exits at orifice 14. Heat transfer medium enters the heat exchanger at orifice 16 and travels in a counterflow direction within the heat exchanger to exit at orifice 15. Devices, such as metal strips 17, are frequently installed in the tubes or pipes of such conventional tube and shell heat exchangers in order to enhance the internal film coefficient at its inside tube wall. Such devices can be twisted strips of metal or static or motionless mixers. As noted, the major resistance to heat transfer is due to what is called the "film coefficient" at the inside wall of the tubes where the product velocity is low. The cooling or heating medium flows within tubes 19 while the product travels over the outside of the tubes in area 12. It has been determined that the improvement in heat transfer obtained by tube inserts for laminar flow applications is usually in the range of two to five times. However, the use of such devices significantly increases the pressure drop experienced and thus one using such expedients must pay a price.

FIG. 2 shows yet another conventional device employed as both a heat exchanger and static mixer. Device 20 relies upon a different design concept than the conventional tube and shell heat exchanger of FIG. 1 in that the product of interest is introduced within conduit 23 at upstream end 21 while the cooling/heating medium is contained within tubes 24. It is further noted that the linear tube structure shown as element 11 of FIG. 1 is replaced by tube structure 24 in the form of a static mixer built of tubing instead of sheet metal. However, it has been determined that the device shown in FIG. 2 does not provide a good utilization of the exchanger shell available volume, less, in fact, than the conventional tube and shell tube heat exchanger.

It is thus an object of the present invention to provide a device in which a moving fluid product is both mixed and subject to heat transfer as a result of its contact with a fluid medium employed for that purpose.

It is a further object of the present invention to accomplish the above-referenced objects while, at the same time, improving the efficiency of such a device dramatically as compared to devices offered for this purpose commercially. These and further objects of the present invention will become more readily apparent when considering the following disclosure and claims.

SUMMARY OF THE INVENTION

The present invention is directed to a device for effecting heat transfer from a first fluid medium to a second fluid medium passing within the confines of a conduit. The device comprises an inlet for receiving and an outlet for discharging the second fluid medium. The conduit further has a substantially circular cross section and longitudinal axis. The device further comprises a core pipe having a diameter and substantially circular cross section, the core pipe being located along the longitudinal axis of the conduit. The device further includes a series of tubular members, the first tubular member being helically wound upon the core pipe and radially extending from the core pipe and includes at least one additional tubular member also helically wound upon a previously applied helically wound tubular member wherein all windings of each tubular member are uniformly and equally spaced along the helically wound tubular member, the windings being applied at approximately equal 45° angles to the longitudinal axis so that each turn of a tubular member forms an interstice with a turn of an adjacent tubular member of approximately 90°. The various tubular members and core pipe are in fluid communication having an inlet to receive the first fluid medium and an outlet to discharge the first fluid medium. The device is further characterized wherein each tubular member is sized with respect to the core pipe such that the ratio of the diameter of the core pipe to the diameters of the tubular members are substantially whole numbers, and the spacing between starts of all tubular members are substantially equal.

DETAILED DESCRIPTION OF THE INVENTION

Figure 1:
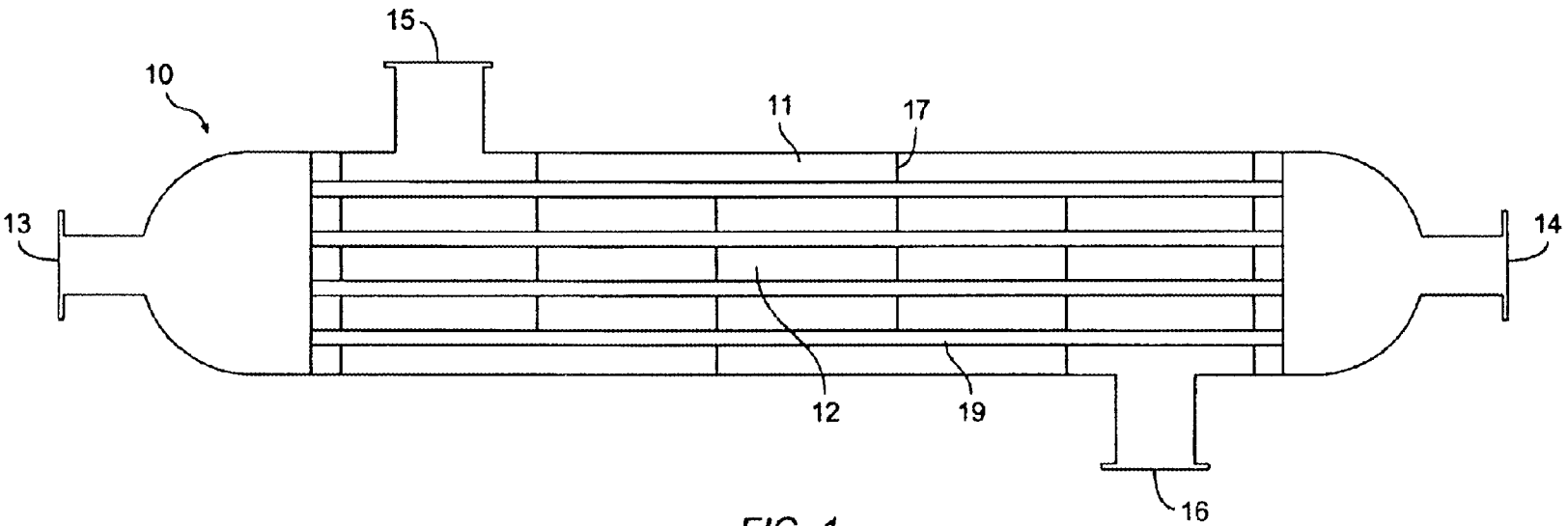
FIG. 1 PRIOR ART
FIG. 1 is a prior art depiction, in cutaway plan view, of a conventional tube and shell heat exchanger.

As noted previously, the present invention is directed to a device for effecting heat transfer from a first fluid medium to a second fluid medium and for enhancing mixing and uniform distribution of the second fluid medium within the confines of a conduit. This can perhaps best be visualized by referring to FIG. 4. Device 40 is shown as consisting of conduit 41 having a cross section and longitudinal axis 42. The conduit is provided with an inlet 43 for introduction of the first fluid within conduit 41 and an outlet 44 for passing the first fluid from the conduit. The conduit further is provided with inlet 45 for the introduction of the fluid product as well as downstream exit 46 for passing the product fluid from conduit 41.

Figure 3A:
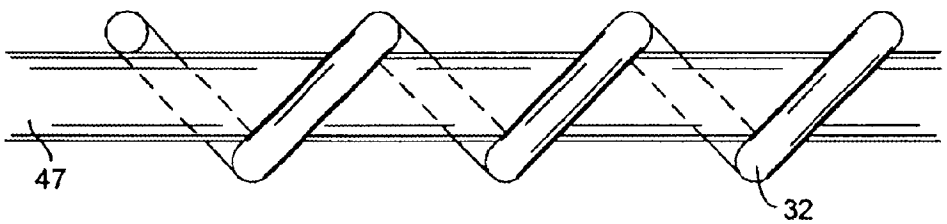
FIGS. 3A to 3C depict, in plan view, the step-by-step construction of the presently configured invention.
Figure 2:
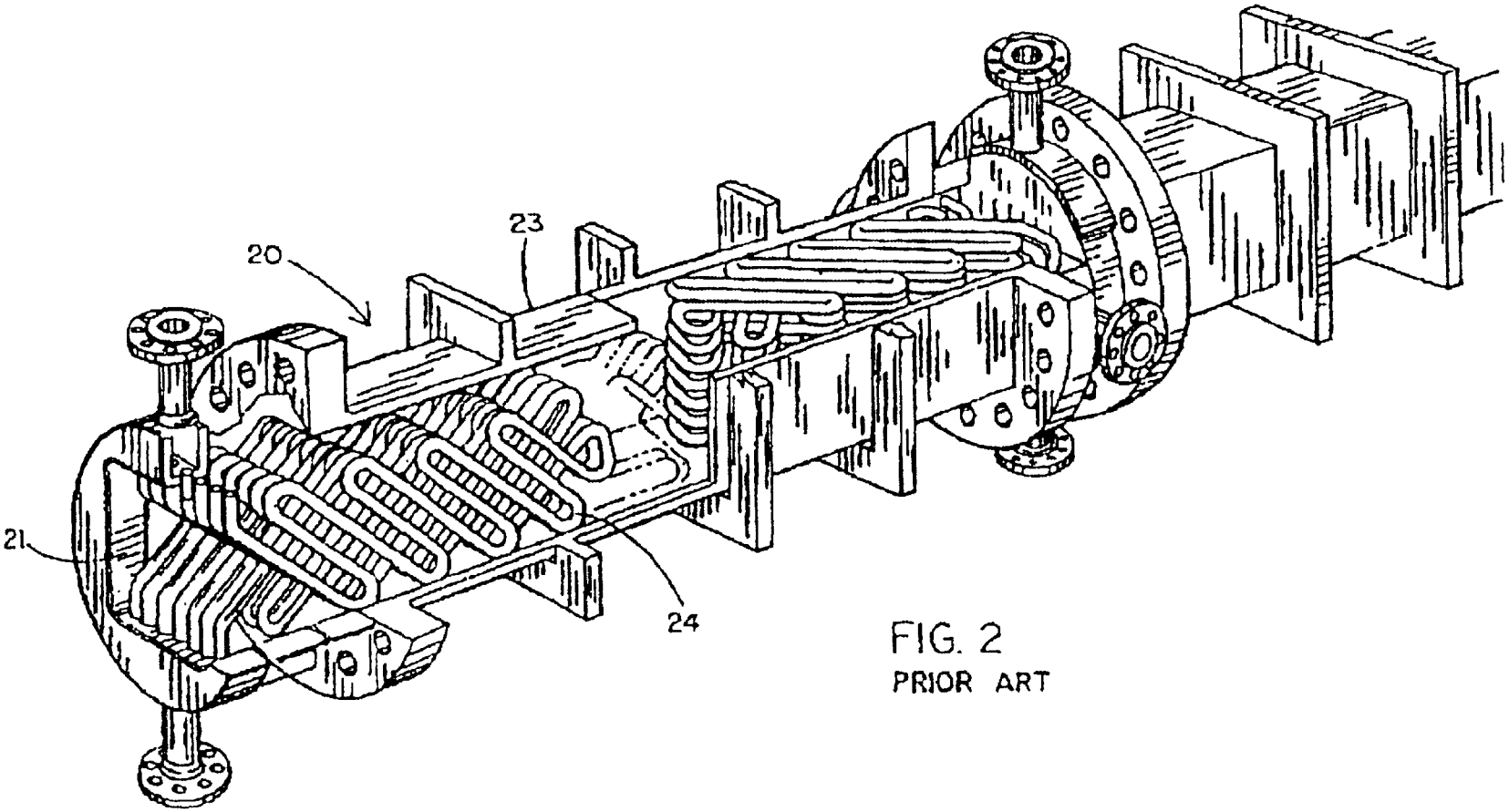
FIG. 2 PRIOR ART
FIG. 2 is a perspective cutaway view of a modified tube and shell heat exchanger, which represents the current state of the art.
Figure 3B:
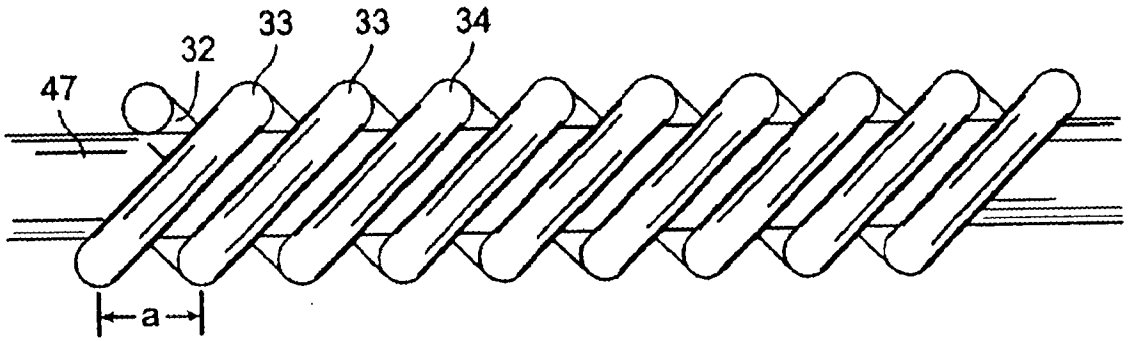
Figure 3C:
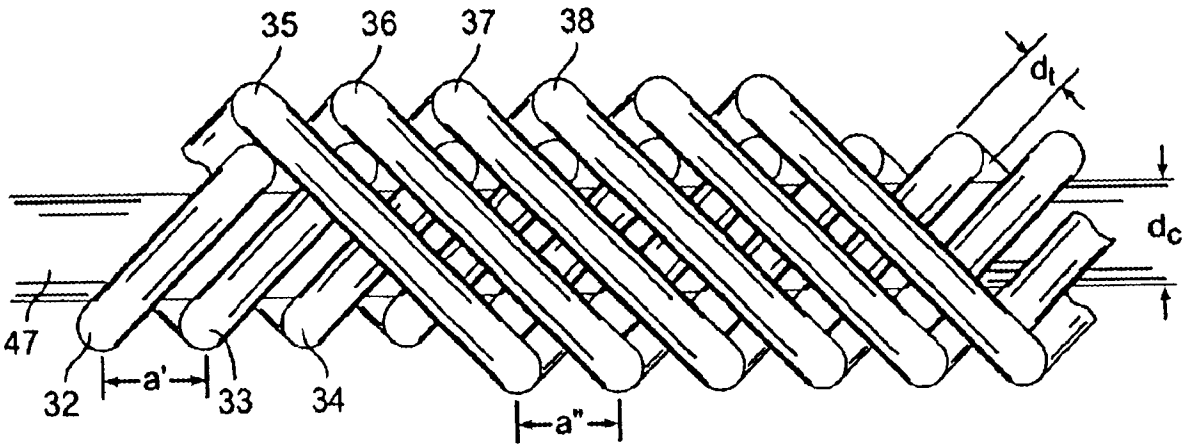
Figure 4:
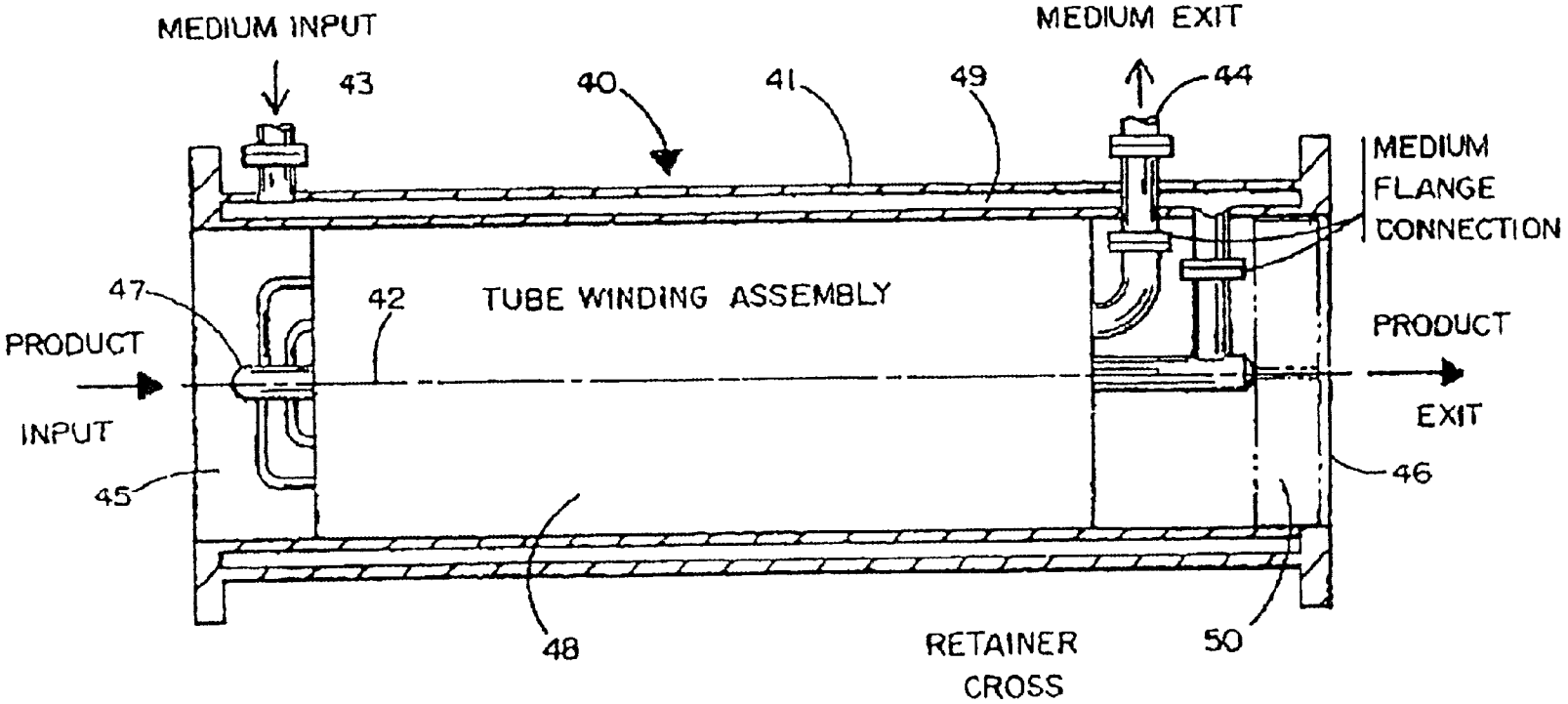
FIG. 4 is a cutaway plan view depicting employment of the structure shown in FIG. 3 within a conduit for accomplishing the goals of the present invention.

Referring further to FIG. 4, the device is provided with core pipe 47, which is also depicted as element 47 in FIG. 3. As shown, the core pipe is located approximately at longitudinal axis 42. The device is further provided with a series of tubes which, for the sake of simplicity, are not shown within FIG. 4 but which are contained in area 48. As will be discussed in more detail, these tubes are helically wound around core pipe 47 and each is configured to carry the first fluid medium.

In operating the device of FIG. 4, it is noted that the heating or cooling medium enters at 43 at the upper left-hand flange and flows via an outer jacket 49 to the output end of the conduit where it enters core pipe 47. The medium flows in core pipe 47 through the center of the conduit and to the end of the winding assembly where the product to be heated or cooled enters at 45 to flow over the outer surface of the tube assembly contained within area 48. Appropriate tube connections take the first fluid from the core tube and distributes it to the winding assembly. This first fluid flows through an inlet to the core pipe and on to the tube assembly where another set of tube connections at the downstream end of the winding assembly join the pipe providing for first fluid exit at 44. In the embodiment shown in FIG. 4, the downstream end of core pipe 47 is plugged and rests against retainer cross 50 welded or otherwise connected to the conduit housing. Retainer cross 50 prevents the tube assembly from extrusion out of the housing by forces produced by pressure drop across the tube assembly. As per standard practice, flanges are provided at the extremities of the conduit so that the tube assembly can be disconnected to allow the entire structure to be removed as required for inspection, cleaning and repair.

The tube windings to be contained within area 48 of FIG. 4 will now be described in some detail.

The addition of multiple and consecutive helically wound layers of tubing upon core pipe 47 is shown in consecutive FIGS. 3A through 3C and discussed with regard to FIGS. 5A through 5E. Specifically, FIG. 3A shows a single tube 32 wound in a helical fashion about core pipe 47. Additional windings are shown in FIG. 3B wherein tubes 32, 33 and 34 are shown wound about core tube 47 each bearing the same sign. Finally, FIG. 3C depicts core tube 31 having tube windings 32, 33 and 34 of one sign and tubes 35, 35, 37 and 38 also helically wound about core tube 47 of an opposite sign.

FIG. 3C shows the preferred manner in which the various series of tubes are wound about a core pipe. Specifically, as noted, each of the tubes being helically wound around the core tube is wound at equal and uniform angles to the longitudinal axis of the core pipe. In addition, each of the tubes is composed of a series of helical turns, each turn being approximately 45° to the longitudinal axis. As such, where each of the tubes is of a helical sign opposite to an adjacent tube, interstices are created between adjacent tubes of approximately 90°.

As noted previously, a characterizing feature of the present invention is providing a series of tubular members wound about core pipe 47 comprising a first tubular member wound directly upon the core pipe, and radially extending from core pipe 47 is at least one additional tubular member containing segments 35, 36, 37, 38, etc., built upon previously applied core pipe starts 32, 33, 34, etc. It is further a design feature of the present invention that all of the windings of each of the tubular members be uniformly and equally spaced along each helically wound tubular member. In this regard, reference is made to FIGS. 3B and 3C, noting that spacing a, a' and a" will all be substantially equal.

Reference is next made to FIGS. 5A to 5E. In this regard, it is noted that a design feature to further enhance the performance of the present invention is that each tubular member be sized with regard to the core pipe such that the ratio of the diameter of a core pipe to the diameters of the tubular members be substantially whole numbers, and that the spacing between tubular members starts be substantially equal. In order to appreciate these various concepts, reference is made to FIGS. 5A through 5E, read in conjunction with the following examples.

Figure 5A:
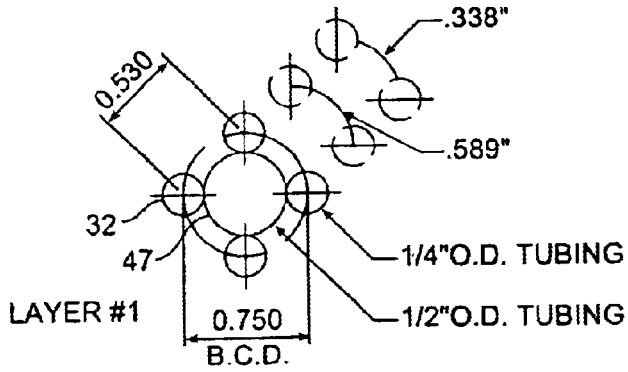
FIGS. 5A through 5E depict an example of appropriate helical tube application to a core pipe focusing on the geometry and spacing of the various elements in practicing the present invention.

Reference is first made to FIG. 5A showing in cross section an end view of core pipe 47 and first tubular member 32.

If $D_{WT}$=the diameter of various helical tubular members, chosen as, for example, ¼" and $D_{CT}$=the core pipe diameter chosen, for example, as ½", knowing that $D_{CT}/D_{WT}=R$ allows one to make certain design and engineering decisions.

Practical winding techniques have shown that a value of R=1½ is manageable, but with great difficulty, while making R=2 is fairly easy, so it is established that $D_{CT}=2\ D_{WT}$. This makes it mechanically convenient for the first winding layer to have four starts.

For a static mixer to be effective, uniform spatial distribution of the interstices where stream division occurs is a definite design goal. To do this, the distance between adjacent windings of a given layer are to be the same and have a 45° winding angle relative to the longitudinal axis of the assembly. This will make the interstice angles between one layer of tubular members and the next equal to the optimum value of 90°.

If $D_{BC}$ is the "bolt circle" diameter of a given tube winding as seen from an end view where helically wound tubular members have been straightened from an angled winding to one whose ends are parallel to the assembly axis, as shown in FIG. 5A, the first layer having four tubular windings 32 results in a bolt circle circumference of $\pi D_{BC}=\pi(0.5+0.25)=2.356$. This results in a distance along the centerline of the bolt circle between adjacent turns of 2.356/4=0.589.

Figure 5B:
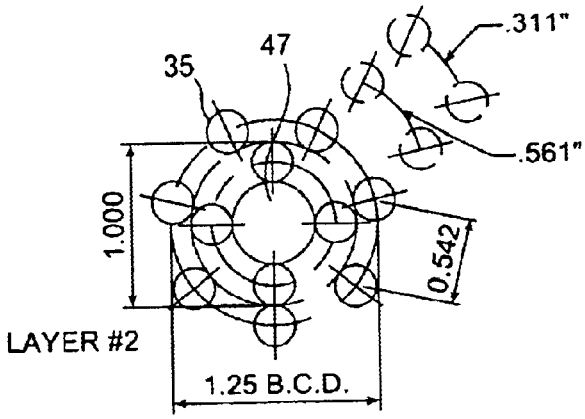
Figure 5C:
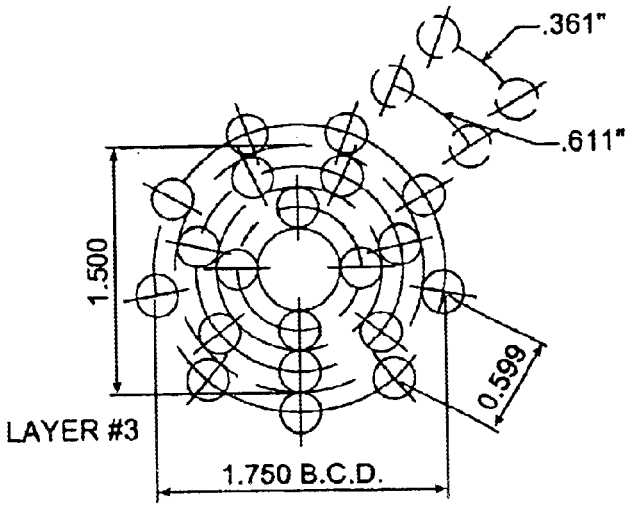
Figure 5D:
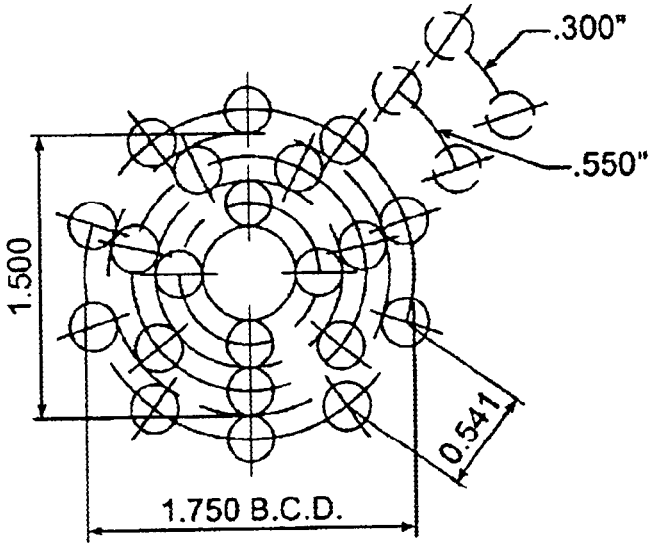
Figure 5E:
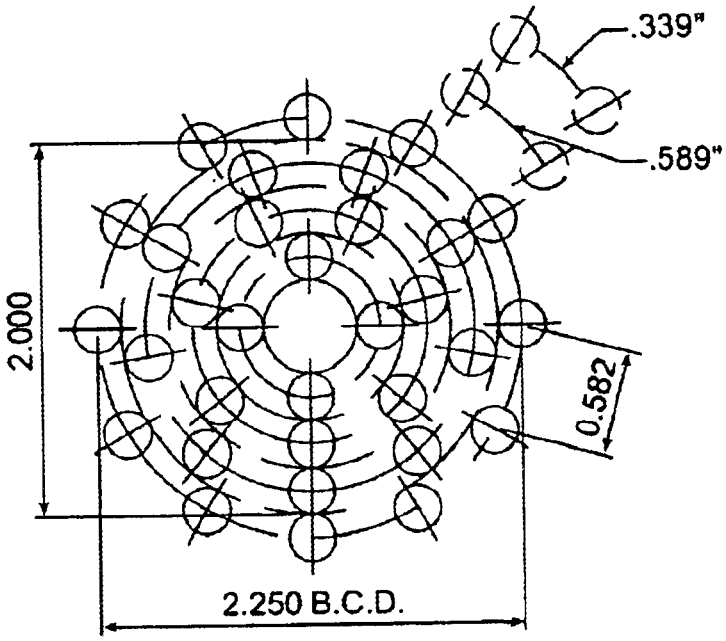

Turning to FIG. 5B, if the next layer of tubular members is chosen to have seven starts, the distance along the bolt circle centerline between adjacent turns is 0.561 which results reasonably close to the value of 0.589 calculated for the first layer.

At layer 3 (FIG. 5C), a bolt circle diameter of 1.75 is calculated. Nine starts provide an adjacent turn separation of 0.611 while ten starts (FIG. 5D) provide a value of 0.550. Based upon these calculations and the desire to provide, as a design goal of the present invention to have substantially equal spacing between tubular members, at this layer of tubes, one would have selected ten starts rather than nine as this provides a number closer to the bolt circle values of the adjacent layers.

On layer 4, twelve starts (FIG. 5E) provide a value of 0.589 which perfectly matches the value calculated for the first layer.

In fabricating the device of the present invention, it is contemplated that core pipe 47 be assembled in fluid communication with various layers of tubular members as shown. Once the sub-assembly has been completed, it is copper brazed in order to improve its fluid dynamics and its heat transfer characteristics when nested within the conduit.

Figure 6A:
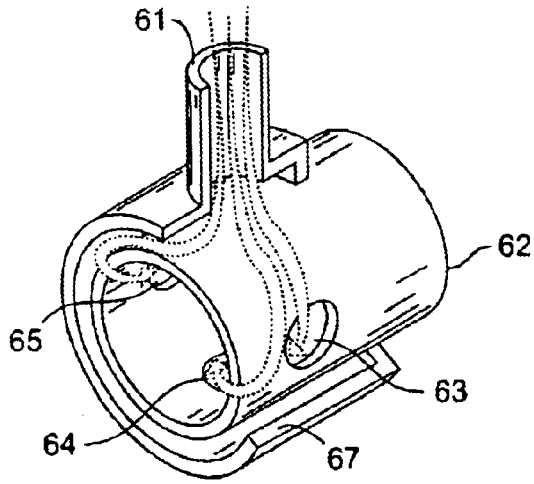
FIGS. 6A, 6B and 6C are various views of a preferred feed system for the second fluid entering the conduit for mixing and temperature modification.
Figure 6B:
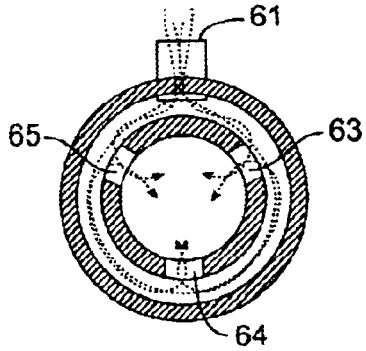
Figure 6C:
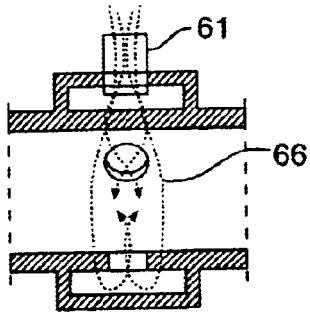

As a further design goal, it is contemplated that the device of the present invention be provided with a plurality of inlets for the second fluid proximate the inlets of the conduit that are uniformly spaced about the periphery of the conduit. In this regard, reference is made to FIGS. 6A, 6B and 6C. Conduit 62 is provided with an outer jacket 67 having pipe member 61 for feeding the appropriate second fluid that can be a multi-component liquid feed stream that would benefit from the heat transfer and mixing characteristics of the present invention. To ensure optimization of heat transfer and mixing functions, the second fluid is introduced along pathways 66 entering conduit 62 through openings 63, 64 and 65 positioned 120° apart along the circular cross section of conduit 62 as best visualized by reference to FIG. 6B. Ideally, from the standpoint of fluid mixing and heat transfer maximization, the diameter of the core pipe is selected to be approximately twice the diameter of the tubular members whereby the first layer of tubular members helically applied to the core pipe are four in number and three inlets as depicted in FIGS. 6A to 6C provided for introducing the second fluid to the interior of the conduit.

In appreciation of the example, which follows, the following recited terms have indicated meanings:

L=overall length of mixer-reactor $d_c$=outside diameter of core pipe

=inside diameter of first layer winding $d_t$=diameter of tubing n=layer number $d_n$=inside diameter of layer n $=d_c+2(n-1)\ d_t$ Ideally, as noted above, it was established that $d_c=2d_t$: then, $d_n=2d_t+2(n-1)d_t=2d_t n$ wherein $P_n$=pitch of one turn of layer n =π×turn inside diameter $=\pi 2d_t n$.

N=number of turns in length L $=L/\pi 2d_t\sqrt{2}$

Therefore, total length of each coil$=L/\pi 2d_t\sqrt{2}\times\pi 2d_t n\sqrt{2}=\sqrt{2}\times L$ Basic Design Numbers for 10" O.D. Unit Core diameter $d_c$=2.00"

Tube diameter=1.0" O.D. with 0.065" wall

Active length of mixer/reactor=96"

Tube length for each coil for each start of all layers=98"×√2 with zero waste

Outside diameter of final assembly=10.0"

Total tubing length required=30×96×√2=4072"=339'

| LAYER NO. | I.D. | TURNS | PITCH | STARTS | TURN-TO-TURN DISTANCE |
|---|---|---|---|---|---|
| #1 | 2" | 15.28 | 6.28" | 3 | 2.09" |
| #2 | 4" | 7.64 | 12.57" | 6 | 2.09" |

-continued

| LAYER NO. | I.D. | TURNS | PITCH | STARTS | TURN-TO-TURN DISTANCE |
|---|---|---|---|---|---|
| #3 | 6" | 5.09 | 18.85" | 9 | 2.09" |
| #4 | 8" | 3.82 | 25.13" | 12 | 2.09" |

Since turn to distance is a constant=pitch/starts, the number of interstices throughout the volume is a constant.

Total number of tubes=30

Total tube area outside=30×π×1×96×√2/144=88.9 $ft^2$

Area from core tube=π×2×96/144=4.2 $ft^2$

10" housing area contribution=π×10×96/144=20.94 $ft^2$

Total exchanger area=114 $ft^2$

This design can be compared with a conventional shell and tube exchanger having 42 tubes[1] each having an inside diameter of 0.87".

[1]This design value is taken from pages 11–15 of the 5th Edition of *The Chemical Engineers Handbook*.

Area=π×0.87×42×96/144=76.5 $ft^2$

The new design then has a surface area advantage by a factor of 1.49 or 45%.

The design detailed here produces windings that cross each other at an angle of 90° and at 45° to the axis.

In addition to the significant advantage in surface area provided by this design, the static mixer system created by the helical windings will also improve heat transfer giving an overall advantage over the conventional shell and tube exchanger of three to ten times.

In addition to the heat exchange area increase provided by the helical windings, there is yet another advantage. The static mixer effect is achieved at the tube external surfaces, which is known to enhance heat transfer by a significant factor of three or more. This is achieved without the manufacturing complication and cost of installing mixing elements in tubes.

While the principles of this invention have been discussed above in connection with several alternative embodiments, it should be understood that those of ordinary skill in this art might find numerous other applications of the principles. Accordingly, the invention is not limited to the specific exemplary applications described above but may be employed in any situation in which a fluid is intended to be mixed and undergo simultaneous heat transfer.

What is claimed:

1. A device for effecting heat transfer from a first fluid medium to a second fluid medium passing within the confines of a conduit, said device comprising an inlet for receiving and an outlet for discharging said second fluid medium, said conduit having a substantially circular cross section and longitudinal axis, said device further comprising a core pipe having a diameter and substantially circular cross section, said core pipe being located along said longitudinal axis and a series of tubular members, a first tubular member being helically wound upon said core pipe and radially extending from said core pipe and at least one additional tubular member being helically wound upon a previously applied helically wound tubular member wherein all windings of each tubular member being uniformly and equally spaced along said core pipe, said windings being applied at approximately equal 45° angles to said longitudinal axis so that each turn of a tubular member forms an interstice with a turn of an adjacent tubular member of approximately 90°, said tubular members and core pipe being in fluid communication having an inlet to receive said first fluid medium and an outlet to discharge said first fluid medium, said device being further characterized by each tubular member being sized with regard to the core pipe such that the ratio of the diameter of the core pipe to the diameters of the tubular members being substantially whole numbers and wherein the spacings between starts of all tubular members are substantially equal.

2. The device of claim 1 wherein said core pipe and all tubular members are copper brazed as a singular assembly fit within said conduit.

3. The device of claim 2 wherein a plurality of inlets are provided for said second fluid medium proximate said inlet of said conduit, said plurality of inlets being uniformly spaced about the periphery of said conduit.

4. The device of claim 1 wherein the diameter of said core pipe is approximately twice the diameter of said tubular members.

5. The device of claim 4 wherein said first tubular member comprises four individual tubes helically wound around said core pipe.

6. The device of claim 3 wherein three inlets are provided for introducing said second fluid to said conduit.

7. The device of claim 1 wherein bolt circle diameters are established between tubular windings within each helically wound tubular member, said bolt circle diameters being substantially constant throughout all tubular members.

* * * * *